US010155638B2

(12) United States Patent
Baranov et al.

(10) Patent No.: US 10,155,638 B2
(45) Date of Patent: Dec. 18, 2018

(54) LOCKING BREAKDOWN SPOOL

(71) Applicant: SONOCO DEVELOPMENT, INC., Hartsville, SC (US)

(72) Inventors: Fedor Baranov, East Greenbush, NY (US); Edmond Louis Fratianni, Old Chatham, NY (US)

(73) Assignee: Sonoco Development, Inc., Hartsville, SC (US)

( * ) Notice: Subject to any disclaimer, the term of this patent is extended or adjusted under 35 U.S.C. 154(b) by 720 days.

(21) Appl. No.: 14/730,627

(22) Filed: Jun. 4, 2015

(65) Prior Publication Data

US 2016/0355371 A1 Dec. 8, 2016

(51) Int. Cl.
*B65H 75/22* (2006.01)
*B65H 75/14* (2006.01)

(52) U.S. Cl.
CPC ..... *B65H 75/22* (2013.01); *B65H 75/14* (2013.01); *B65H 2701/50* (2013.01); *B65H 2701/5136* (2013.01)

(58) Field of Classification Search
CPC .... B65H 75/22; B65H 75/14; B65H 2701/50; B65H 2701/5136
See application file for complete search history.

(56) References Cited

U.S. PATENT DOCUMENTS

| | | | |
|---|---|---|---|
| 3,552,677 | A | 1/1971 | Hacker |
| 3,785,584 | A | 1/1974 | Crellin, Jr. |
| 3,822,841 | A | 7/1974 | Campbell |
| 5,575,437 | A | 11/1996 | Campbell |
| 5,868,348 | A | 2/1999 | Bulman |
| 6,045,087 | A | 4/2000 | Vislocky et al. |
| 6,089,500 | A | 7/2000 | Hafner |
| 7,073,746 | B2 | 7/2006 | Lorenzo Barroso |
| 7,828,242 | B2 | 11/2010 | Snitselaar |
| 8,272,591 | B2 | 9/2012 | Baranov et al. |
| 8,328,127 | B2 | 12/2012 | Ito et al. |

(Continued)

FOREIGN PATENT DOCUMENTS

| | | | |
|---|---|---|---|
| JP | 201458395 | A | 4/2014 |
| WO | 9509800 | A1 | 4/1995 |
| WO | 0208107 | A1 | 1/2002 |

OTHER PUBLICATIONS

PCT/US2016/035612—Invitation and partial search report; dated Aug. 11, 2016.

*Primary Examiner* — Sang K Kim
*Assistant Examiner* — Nathaniel L Adams
(74) *Attorney, Agent, or Firm* — Flaster/Greenberg P.C.

(57) ABSTRACT

A breakdown spool having a hollow barrel and separate flange members is provided. The barrel ends define an insertion section for movement into a central recess positioned within the support surface of the flanges. The central recess includes an outer peripheral wall having an inside diameter closely dimensioned with an outside diameter of the barrel wall. The insertion sections on the ends of the barrel and the central recess of each flange having first and second engagement elements for releasably securing the flanges to the axial ends of the barrel. The engagement elements have different structural forms. Interconnecting alignment elements are provided to fix the relative position of the axial end of the barrel with respect to the central recess of the flange and to align the respective first and second engagement elements on the insertion section and the peripheral wall around the perimeter of the central recess.

32 Claims, 14 Drawing Sheets

(56) References Cited

U.S. PATENT DOCUMENTS

| | | | |
|---|---|---|---|
| 8,424,796 | B2 | 4/2013 | Witmer et al. |
| 2005/0279877 | A1 | 12/2005 | Barroso |
| 2007/0181739 | A1 | 8/2007 | Derendal |
| 2007/0262192 | A1 | 11/2007 | Derendal |

LOCKING BREAKDOWN SPOOL

FIELD OF THE INVENTION

The present disclosure relates to a construction for a breakdown reel or spool that is used to store and transport elongated flexible materials, such as wire or cable.

BACKGROUND OF THE INVENTION

A breakdown reel or spool typically includes separate flange and barrel portions that are fixed to form a complete assembly. Preferably, the barrel structure and flange portions are locked together and may be separated when desired. A number of forms of breakdown spools are known.

U.S. Pat. No. 8,272,591 to Baranov et al. shows a breakdown spool having a receiving channel with a locking system for axially locking the barrel to the flange and a separate radial locking member for releasably fixing the rotational position of the barrel upon axially locking the barrel to the flange.

U.S. Pat. No. 5,575,437 to Campbell shows breakdown spool construction wherein the barrel portion includes a plurality of latching fingers on each barrel end. The latching fingers include alternating locking abutments, aligning ribs and guide surfaces that axially engage within corresponding receiving channels within a central recess in the flange portion of the spool.

U.S. Pat. No. 3,785,584 to Crellin, Jr. shows a breakdown spool having a barrel including a series of axial projections on the barrel ends. The axial projections of the barrel are received within slots in a central recess of a flange and are locked to the flange by resilient tabs formed within the central recess of the flange.

U.S. Pat. No. 3,822,841 to Campbell shows a breakdown spool having a plurality of latching fingers interleaved within the ends of the barrel. The latching fingers include radially projecting abutments that fit within openings in a central recess of the flange. The fingers flex inwardly to allow the abutments to enter the recess and flex outwardly to engage the abutments.

US 2007/0262192 and US 2007/0181739 to Derendal show breakdown spool constructions with outwardly projecting locking tabs on the ends of the barrel. The tabs are inserted into separate recesses within the wall of the flanges. A knob is formed on each of the locking tabs and is positioned to engage in a slot upon rotation of the barrel relative to the flange. Flexible retaining members are formed within the barrel wall on the ends of the barrel, each with a nub extending axially from the end of the barrel.

U.S. Pat. No. 6,089,500 to Hafner shows a breakdown spool having a bayonet coupling between the hub and the flange. A series of retaining elements are positioned on the outside surface of the end of the barrel. The retaining elements lock with a series of inwardly projecting locking elements formed on the wall of a circular recess in the flange.

SUMMARY OF THE INVENTION

In a first aspect of the disclosure, the breakdown spool includes a barrel having a longitudinal axis and a barrel wall substantially surrounding the longitudinal axis. The barrel wall forms an annular winding surface and an insertion section on at least one axial end of the barrel wall. The insertion section of the barrel includes at least one flexible tab formed within the barrel wall, with the tab having a radially outward projecting cleat on its end. A plurality of insertion clips are spaced from one another and from the tab. At least one flange is provided having a support surface and a central recess positioned within the support surface. The central recess is formed for receiving the insertion section of the barrel. The central recess includes a first opening for receiving the projecting cleat on the tab upon alignment with and introduction of the insertion section into the receiving channel. A plurality of receiving clips are spaced relative to the first opening, with the spacing of the receiving clips corresponding to the spacing of the plurality of insertion clips relative to the at least one tab on the insertion section of the barrel. The receiving clips are each form for axial overlap and engagement with a corresponding insertion clip upon alignment of the tab with the first opening upon introduction of the insertion section within the central recess. The tab on the insertion section of the barrel flexing radially inward upon introduction or movement into the receiving channel. The inward flex of the tab clearing the cleat for introduction of the insertion section on the end of the barrel into the central recess. The return of the tab to a normal, non-flexed position that is substantially aligned with the barrel wall moves the cleat into engagement with the opening within the receiving channel. The barrel wall adjacent the insertion clips also flexes for movement of the insertion clips into overlapping engagement with the corresponding receiving clips. The insertion clips and receiving clips each having an engagement channel portion formed adjacent thereto. The engagement channel allowing rotational movement of the flange relative to the insertion section of the barrel after radially inward flexing of the at least one tab and release of the cleat from engagement within the first opening. The rotational movement of the flange and barrel serving to release the axial overlap and engagement of the clips for withdrawal of the engagement of the barrel from the flange.

In a further aspect of the breakdown spool, the barrel may include at least two flexible tabs formed on the insertion section of the axial end of the barrel. The two tabs each have a projecting cleat thereon. The tabs are preferably positioned diametrically opposite on the axial end of the barrel. The flange may further include a second opening, with the openings aligned with the tabs for receipt of the corresponding cleats. An alignment tab may be provided on the flexing tab(s), with a corresponding alignment slot formed on the flange adjacent the opening(s). The alignment slot is formed to receive the alignment tab during introduction of the insertion section into the central recess.

In a further aspect of the breakdown spool, the barrel is preferably integrally molded from a thermoplastic material. The flanges may also be molded from a thermoplastic material. The barrel preferably includes a substantially central hollow defined by an inside wall. The central recess may include an outer peripheral sidewall, with the first opening formed within the peripheral sidewall and the plurality of receiving clips formed on the peripheral sidewall. The central recess may further include an internal support positioned radially inward of the peripheral sidewall. The spacing between the internal support and the sidewall defining a channel formed for receiving the insertion section of the barrel and the internal support preferably engaging the inside wall of the barrel. The internal support may include a ring member having a projecting height that is less than the height of the sidewall. A plurality of radially extending support ribs may be formed within the central recess, inwardly of the support wall. The internal support may further include a plurality of angled projections that are preferably integrally formed with the ring member and that include a height greater than the height of the ring. The angled projections comprise a directing surface radially inward from the ring member toward the receiving channel. A second plurality of angled projections may be provided in a spaced relationship with respect to the projections formed with the support ribs. Further, the projecting cleat may include an angled surface for engaging the outer periphery sidewall adjacent the first opening upon an initial introduction of the barrel end into the central recess. Alignment indicia may be provided on the barrel wall or on the flange support surface to indicate the positional location of the tab(s) on the insertion section and the opening(s) within central recess.

In a further aspect of the disclosure a breakdown spool is defined as having a substantially hollow barrel. A barrel wall surrounds a longitudinal axis and forms an annular winding surface. An insertion section is formed on each axial end of the barrel wall. The insertion sections each include two diametrically opposed flexible tabs formed within the barrel wall, with each tab having a base portion and a free end portion. The tabs are connected at the base to the barrel wall. The ends of the tabs have a radially outward projecting cleat thereon. A plurality of insertion clips are provided in a spaced relationship with respect to one another and to the tabs. Two similarly formed flange members are provided, with each flange member having a support surface and a central recess. The central recess is preferably formed for receiving the insertion section of the barrel and includes an outer peripheral wall having an inside diameter closely dimensioned with an outside diameter of the annular winding surface or at least the insertion of the barrel. A pair of receiving openings are formed within the outer peripheral wall, with the openings each defining an engagement lip adjacent the support surface. The openings are formed for receiving the projecting cleats on the tabs upon introduction of the insertion section of the barrel into the central recess of a respective flange.

In a further aspect of the disclosure, a plurality of receiving clips is spaced relative to the pair of openings, with the spacing corresponding to the spacing of the insertion clips. The receiving clips are each formed to axially overlap and engage with a corresponding insertion clip upon alignment of the flexible tab with the first opening and upon introduction of the insertion section into the receiving channel. Each of the tabs flex radially inward upon introduction of the insertion section on one end of the barrel into the receiving channel of the flange. The inward flex of the tabs clearing the cleat for insertion into the aligned opening in the peripheral wall of the central recess and a return flexing of the tabs to a normal position aligned with the barrel wall. The barrel wall adjacent the insertion clips flexing for movement of the insertion clips into engagement with the corresponding receiving clips. Each of the insertion clips and receiving clips comprise an engagement channel portion formed adjacent thereto. The engagement channel allows relative rotational movement of the flange about the axis of the barrel after radially inward flexing of the tabs and axial release of the cleat from the lip and the opening. The relative rotational movement removing the axial overlap and engagement of the respective clips for axial withdrawal of the barrel from the flange.

In a further aspect of the breakdown spool, an alignment tab may be formed on at least one tab on each end of the barrel. An alignment slot may be formed on the flange adjacent at least one of the openings in the peripheral sidewall of the central recess. The alignment slot is formed to receive the alignment tab during introduction of the barrel into the central recess of the flange. The central recess of each flange may further include an internal support positioned radially inward of the peripheral sidewall. The spacing between the internal support and the peripheral sidewall preferably defining a channel formed for receiving the insertion section of the barrel, with the internal support engaging with an inside wall of the barrel. The internal support on the flanges may further include a ring member. The ring member may have a projecting height that is less than the height of the peripheral sidewall.

In a further aspect of the breakdown spool, a plurality of radially extending support ribs may be formed within the central recess, inwardly of the support wall. The internal support may further include a plurality of angled projections integrally formed with the ring member, and preferably having a height greater than the height of the ring. The angled projections may include a directing surface angled inwardly from the ring member. The angled projections may be integrally formed with the radially extending support ribs. The angled projections may also be spaced from the support ribs. Alignment indicia may be provided on the barrel wall or on the flange support surface of each flange for indicating the positional location of the tabs within the barrel or the opening within the central recess. The barrel is preferably integrally molded from a thermoplastic material. The flanges may also be molded from a thermoplastic material.

In a further aspect of the disclosure a breakdown spool is provided having a substantially hollow barrel and a pair of flanges. The barrel is essentially defined by a barrel wall preferably surrounding a longitudinal axis and forming a winding surface. An insertion section is formed on each axial end of the barrel wall. Each of the flange members is similarly formed, with a planar support surface and a central recess. The central recess is formed for receiving the insertion section of the barrel and preferably includes an outer peripheral wall having an inside diameter closely dimensioned with the outside diameter of the insertion section of the barrel. The insertion section on the end of the barrel and the central recess within each flange include first and second engagement elements for releasably securing the flanges to the axial ends of the barrel. The first and second engagement elements preferably have different structural forms. The insertion sections of the barrel and the central recess of each flange include interconnecting alignment elements to fix the relative position of the axial end of the barrel with respect to the central recess of the flange, and to align the respective first and second engagement elements on the insertion section and the peripheral wall around the perimeter of the central recess. The first and second engagement elements on the axial ends of the barrel and on each of the flanges are engaged upon connection of the alignment elements during axial introduction of the insertion section of the barrel into the central recess of a flange. The first engagement elements are preferably separately released from the second engagement elements and further release the connection of the alignment elements. The second engagement elements are preferably released by rotation of the flange about the barrel axis with respect to the axial end of the barrel, followed by an axial separation of the flange and barrel end.

In a further aspect of the breakdown spool, the first engagement elements may include two diametrically opposed flexible tabs formed within the barrel wall. Each tab preferably includes a base portion and a free end portion. The tabs are connected at the base portion to the barrel wall and the end portions include a radially outward projecting cleat located within the insertion section. The tabs are capable of flexing radially about the base portion. A pair of receiving openings is formed within the outer peripheral wall and each defines an engagement lip adjacent the support surface of the flange. The receiving openings are formed for receiving the projecting cleats on the tabs upon introduction of the insertion section of the barrel into the respective central recess of a flange. Preferably, each of the tabs is flexed radially inward during the introduction of the insertion section into the receiving channel. The inward flexing of the tabs clears the cleat over and around the lip when the cleat is with the opening in the peripheral wall. The tabs return to their normal (non-flexed) position, substantially aligned with the barrel wall, and the cleat moves into axial engagement with the lip to radially lock within the opening in the wall.

In a further aspect of the breakdown spool, the second engagement elements preferably include a plurality of insertion clips on the insertion section of the barrel. The insertion clips are spaced from one another and from the two tabs. A plurality of receiving clips is provided on the peripheral wall of the central recess. The receiving clips are spaced relative to the pair of openings, with the spacing corresponding to the spacing of the insertion clips relative to the flexible tabs. The receiving clips each formed to axially overlap and engage with a corresponding insertion clip upon alignment of the flexible tab with the first opening and introduction of the insertion section within the receiving channel. The barrel wall adjacent the insertion clips flexing for movement of the insertion clips into engagement with the corresponding receiving clips. Each of the insertion clips and receiving clips have an engagement channel portion formed adjacent thereto. The engagement channel allows relative rotational movement of the flange about the axis of the barrel after radially inward flexing of the tabs and axial release of the cleat from the lip and the opening. The rotational movement releases the axial overlap and engagement of the respective clips for axial withdraw of the barrel from the central recess of the flange.

In a still further example of the breakdown spool, the interconnecting alignment elements include an alignment tab formed on the flexing tabs on each end of the barrel. An alignment slot is also formed on the flange adjacent to the openings in the peripheral sidewall of the central recess. The alignment slot formed to receive the alignment tab upon alignment of the flexible tab and the corresponding opening during the axial introduction of the insertion section of the barrel into the central recess of the flange.

Other features of the present invention and alternate combinations of features will become apparent from the detailed description to follow, taken in conjunction with the accompanying drawings.

BRIEF DESCRIPTION OF THE DRAWINGS

For the purpose of illustrating the invention, the drawings show forms that are presently preferred. It should be understood that the invention is not limited to the precise arrangements and instrumentalities shown in the drawings.

DETAILED DESCRIPTION

Figure 1:
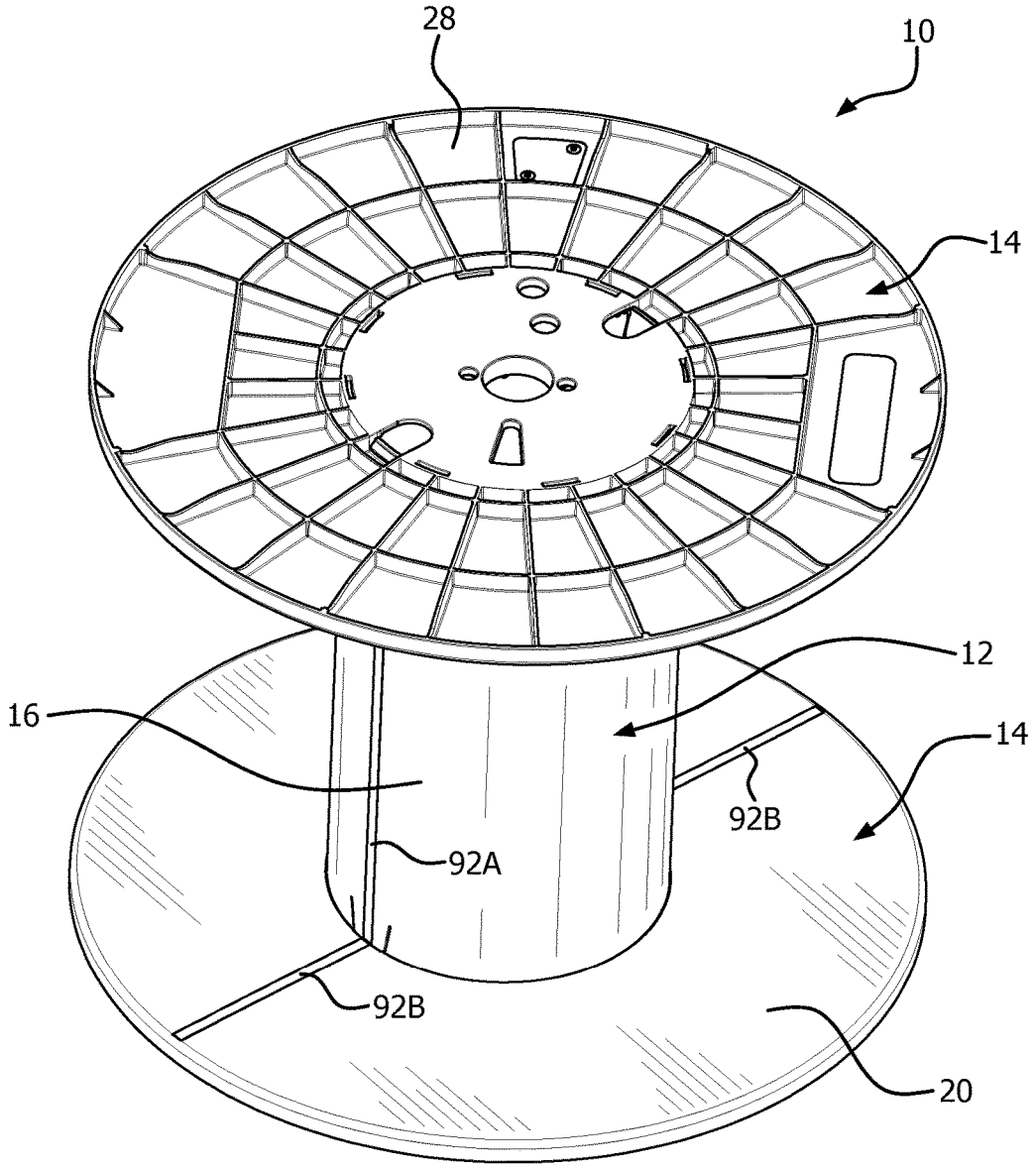
FIG. 1 shows an isometric view of an embodiment of a spool having features contemplated by the present disclosure.

In the figures, where like numerals identify like elements, there is shown an embodiment of a breakdown reel or spool designated by the numeral 10. As shown in FIG. 1, the spool 10 is comprised of a barrel 12 and one or more flanges 14. Two flanges 14 are shown in the figures, although a functional winding spool may include only a single flange if desired. The barrel 12 as shown is preferably defined by an annular winding surface 16, which is generally formed about a longitudinal axis 18 (see FIG. 2). As shown, the barrel has a singular form, with all portions integrally formed as a single piece. The barrel may be assembled from multiple pieces. Each flange 14 includes a support surface 20 directed inwardly towards the winding surface 16 of the barrel 12 in the assembled spool. The winding surface 16 and the support surface(s) 20 engage the elongate material (not shown) to be wound on the spool 10.

Figure 2:
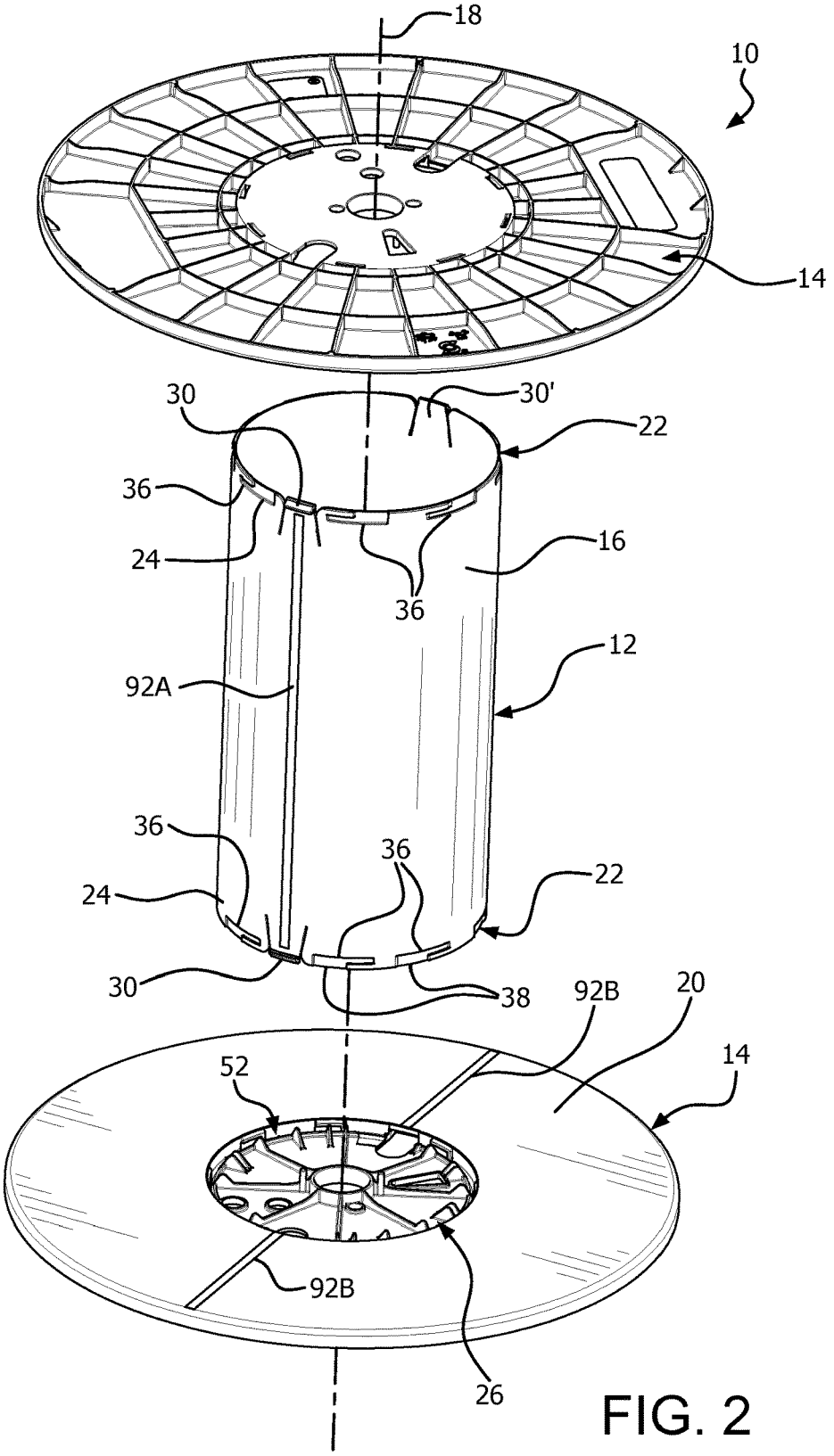
FIG. 2 shows an exploded isometric view of the spool of FIG. 1.
Figure 2A:
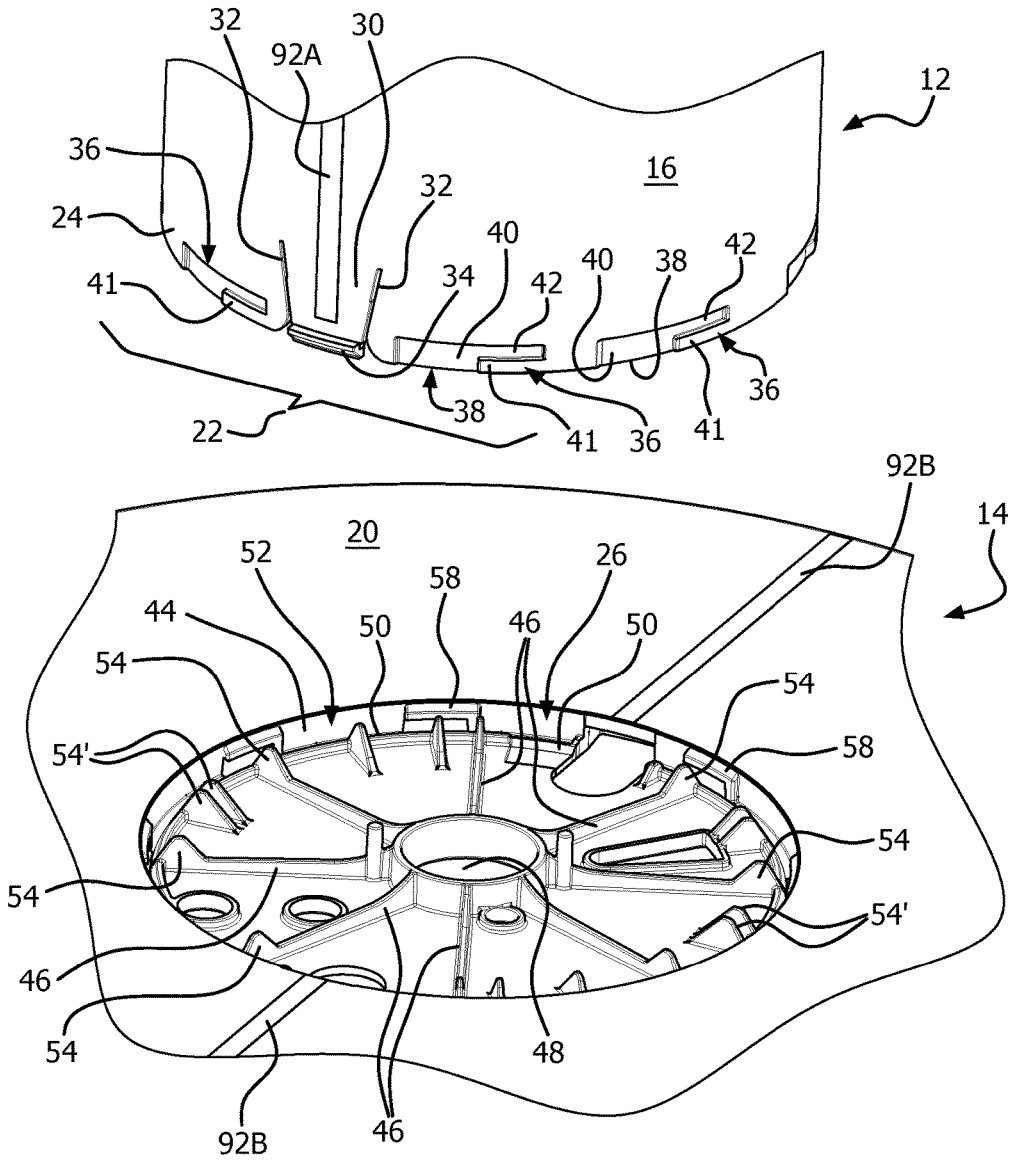
FIG. 2A is an enlarged portion of the view in FIG. 2, showing one end of the barrel and a corresponding portion of the flange.

In FIG. 2, the spool 10 is shown with its constituent parts separated. The barrel 12 includes an insertion section 22 on each longitudinal end 24. A central recess 26 is provided within the support surface 20 of the flange 14 and has a generally circular form. The dimensions of the flange recess 26 are defined to receive and engage the insertion section 22 of the barrel 12. An enlarged view of the insertion section 22 and recess 26 is shown in FIG. 2A. The connection of one of the flanges 14 to one end 24 of the barrel is described below. It should be understood that in the preferred two-flange construction, each flange will be formed in a similar fashion, as will each end of the barrel. The barrel structure is contemplated to be integrally molded from a thermoplastic material. Similarly, the flanges preferably include an integrally molded construction.

As shown in FIGS. 2 and 2A, the insertion section 22 of the end 24 of the barrel 12 includes two separate engagement elements that combined to axially and rotationally fix the barrel 12 within the central recess 26 of each flange 14. A first engagement element is formed in part by the locking tab 30 that is formed within the winding surface 16 of the barrel 12. The locking tab 30 is defined between two slots 32 in the wall of the barrel 12. As shown, the slots extend axially from edge of the longitudinal end 22 of the barrel 12. The slots 32 diverge as they extend along the wall of the barrel 12, with the slots being closer to one another at the barrel end 22. In its normal position, the tab 30 is aligned with barrel wall. A projecting cleat or abutment 34 is formed on the end of the tab 30 and projects radially outward from the winding surface 16 of the barrel 12. The base of the tab 30 is integrally formed with the wall 16 of barrel 12. The form of the tab 30 and the material of the barrel 12 provide flexibility to the tab 30, permitting it to resiliently move inwardly (and outwardly) relative to the remainder of the barrel 12. A second tab 30' of similar form is provided diametrically opposite of the first tab 30 on the end 24 of the barrel 12. The two tabs 30, 30' on one end 24 of the barrel 12 are shown in the exploded view of FIG. 2. A similar arrangement is provided on the opposite end, which is also shown in FIG. 2A.

A second engagement element is formed in part on the barrel 12 by a series of locking clips 36 provided around the periphery of the two ends 24 of the barrel 12. FIG. 2A shows the clips 36 spaced from one another around the insertion section 22 of the barrel 12 on both sides of the locking tab 30. Each clip 36 includes a base hook portion 41 that is surrounded by a channel 38 formed within the wall of the barrel 12. Each channel 38 includes an outer release portion 40 and inner retention portion 42. The hook portion 41 is axially aligned with the retention portion 42 of the channel 38. The channels 38 and hooks 41 of the multiple clips 36 are formed in the same direction around the periphery of the barrel end 24.

The portion of the flange 14 shown in FIG. 2A includes the central recess 26. The recess 26 is formed in the support surface 20. An outer wall 44 defines the perimeter of the recess 26 and creates a shoulder with the adjacent support surface 20. A series of support ribs 46 extend radially outward from an arbor opening 48 in the center of the recess 26. The support ribs 46 serve at least in part to strengthen the flange 14. Other support structures, such as corrugations, may be provided in the central recess 26. A support ring 50 is provided inward of the outer wall 44. The spacing between the wall 44 and the ring 50 creates a receiving channel 52 for receipt of the insertion section 22 of the barrel 12, which is preferably hollow. Angled projections 54 are provided on the ends of the support ribs 46, adjacent to or overlapping with the ring 50. An additional set of angled projections 54' are provided at various positions between the radial ribs 46. The angled projections 54, 54' serve to guide the insertion section 22 of the barrel 12 into the receiving channel 52. In addition, the ring 50 and projections 54. 54' support the engagement of the insertion section 22 in the channel 52.

Within outer wall 44 of the central recess 26 there are provided two openings 56, 56' positioned diametrically opposite one another. The wall openings 56, 56' form a part of the first engagement elements and are aligned with the locking tabs 30, 30' within the insertion section 22 of the barrel 12. In addition, receiving channels 58 are provided on the outer wall 44 in alignment with the clips 36 on the insertion section 22 of the barrel 12. Other openings, structures and marking indicia may be provided within the central recess 26 or associated with the flange or barrel.

Figure 3:
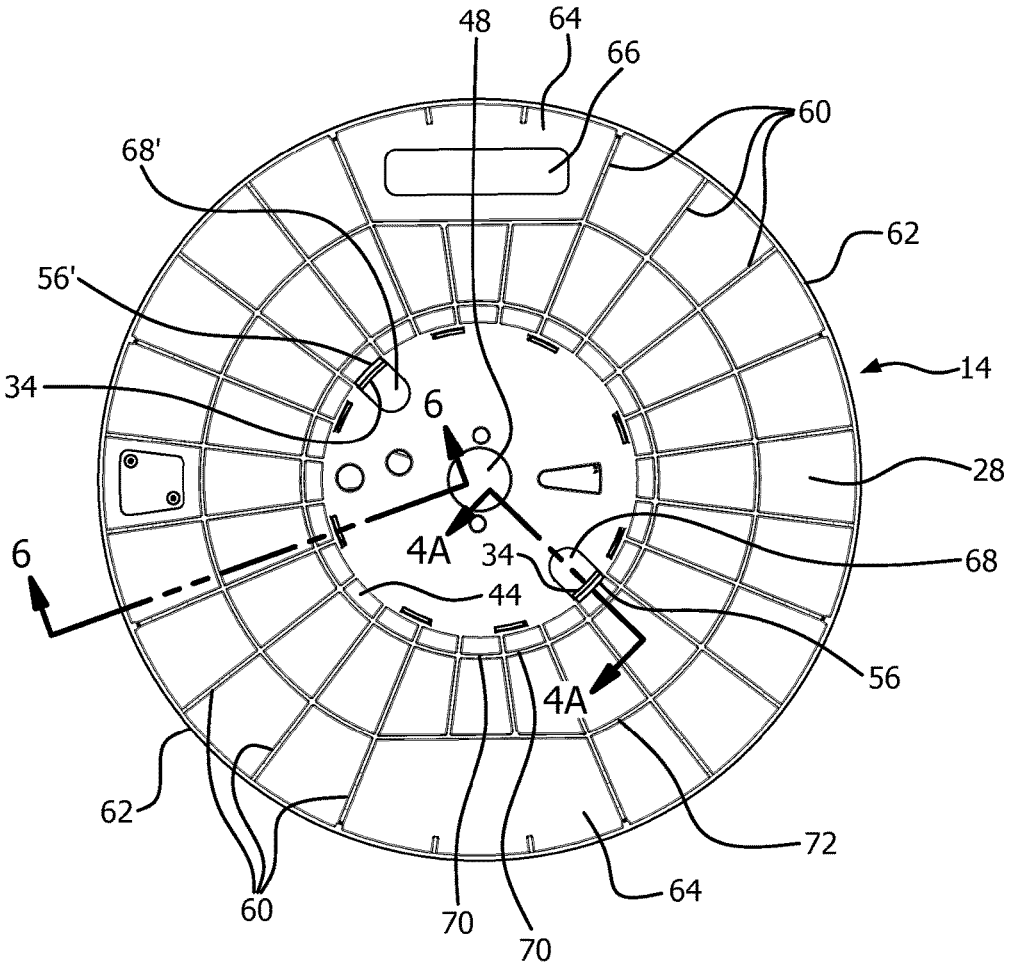
FIG. 3 shows an end view of the flange portion of the spool of FIG. 1, with the barrel end secured to the flange.

In FIG. 3, there is shown the outside or top surface 28 of a flange 14, with the barrel 12 engaged within the receiving channel 52 on the opposite side of the flange 14. The top surface 28 of the flange 14 includes a plurality of raised ribs 60 generally projecting radially. As shown, the raised ribs 60 are joined with the outside of wall 44 and extend to an outer rim 62. Substantially circular ribs 70, 72 intersect with the radial top ribs 60. The circular ribs 70, 72 are concentric with the outer rim 62 of the flange 14 and the radially inward positioned outside wall 44. Open areas 64 are provided in the top surface 28 for identification labels 66 and the like. Access openings 68, 68' are provided adjacent the wall openings 56, 56'. When the barrel 12 is engaged in the receiving channel 52 on the opposite side of the flange 14, the projecting cleats 34 on the tabs 30, 30' engage within the wall openings 56, 56' and are viewed through the access openings 68, 68'.

Figure 4A:
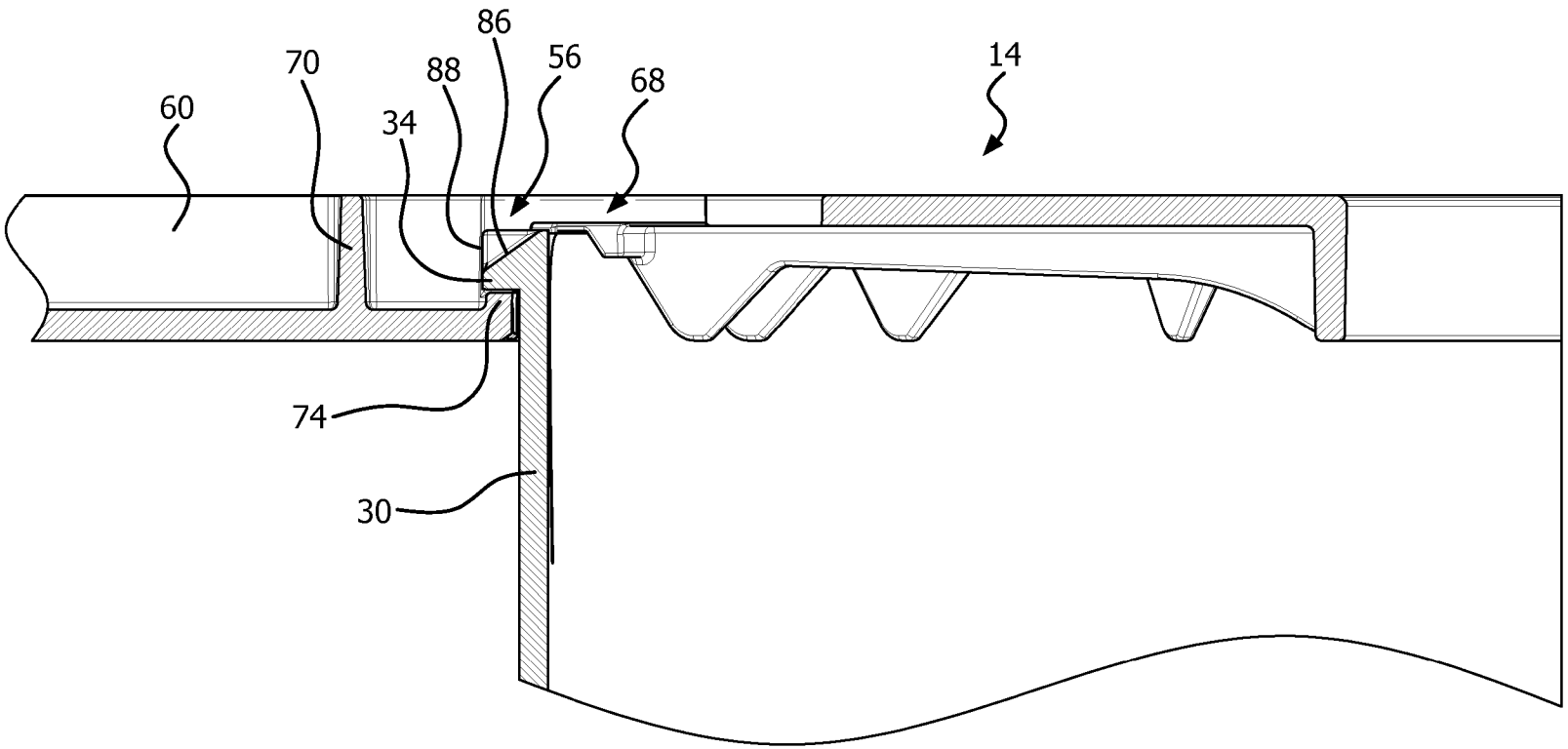
FIG. 4A shows a cross section view of a portion of the connection between the flange and the barrel as taken along lines 4A-4A in FIG. 3.
Figure 4D:
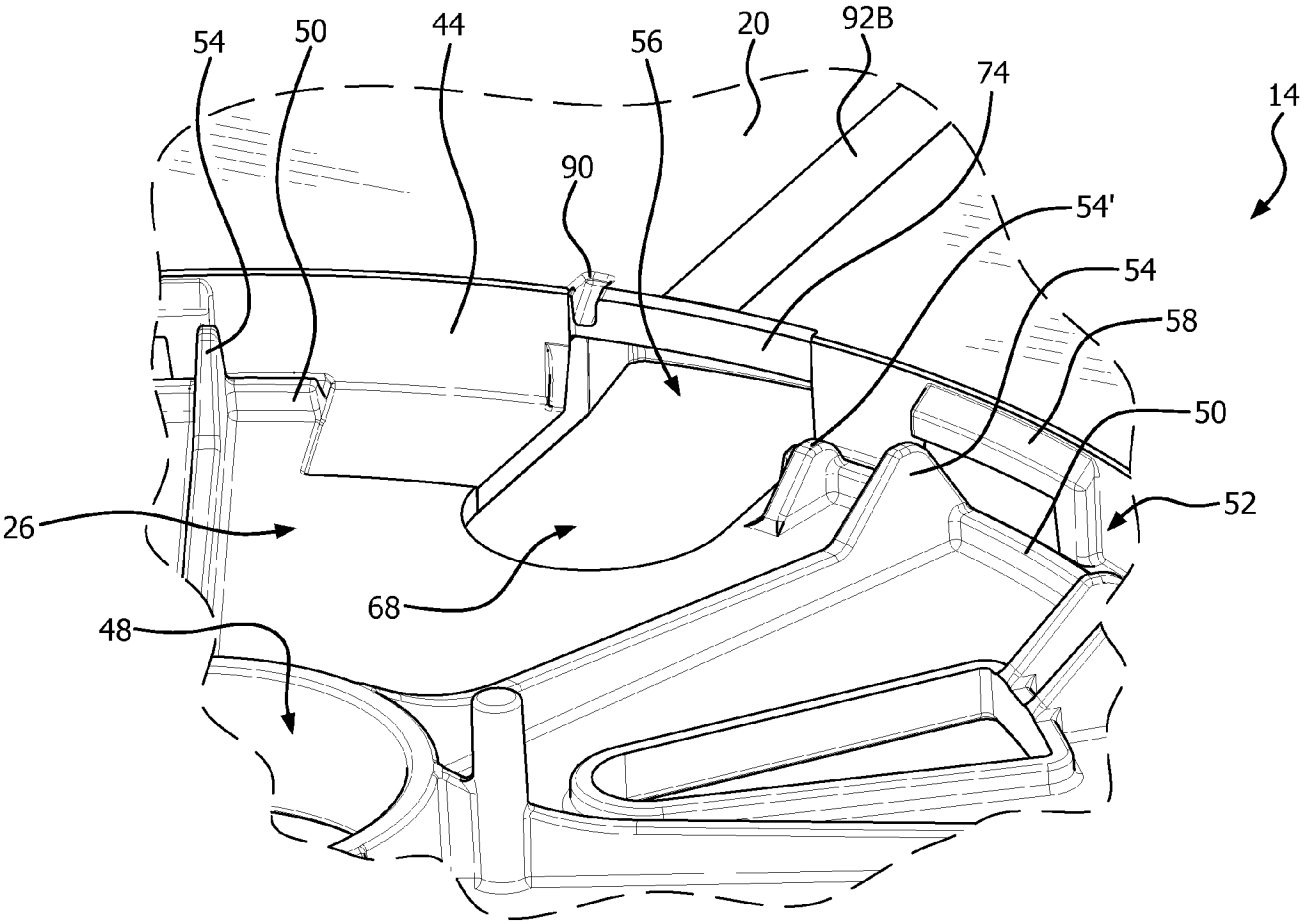
FIG. 4D shows a partial isometric view of the flange, prior to connection of the barrel.
Figure 5:
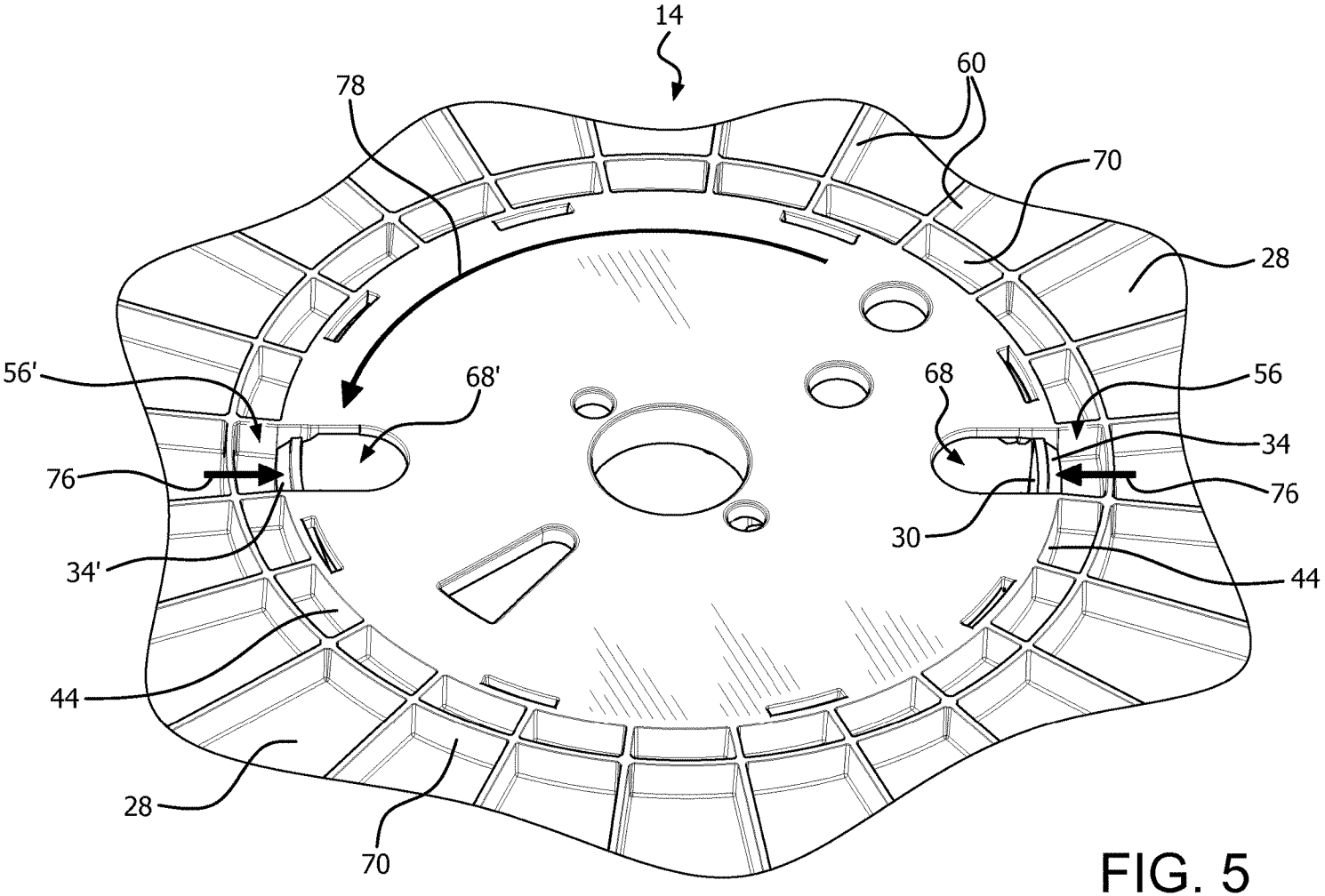
FIG. 5 shows a partial isometric view of the flange, with the barrel end connected thereto and with functional lines showing relative movement of portions of the flange and barrel.

The engagement of the cleat 34 with a lip 74 formed by the wall opening 56 is shown in the cross section of FIG. 4A. The flexible tab 30 formed within the wall 16 of the barrel 12 is flexed inwardly (see arrows 76 in FIG. 5) to permit the cleat 34 to move around the lip 74 and into the opening 56. Upon introduction of the insertion section 22 of the end of the barrel 12 into the central recess 24, the tab 30 flexes back to its normal position and the cleat 34 axially overlaps with the lip 74. As shown, for example, in FIG. 4D, the support ring 50 and ribs 46 are spaced from the wall openings 56, providing clearance for the tabs 30. The cleat 34 on the end of the tab 30 includes an angled engagement edge 86 to assist in guiding the cleat 34 past the lip 74 of the opening 56 (and 56'). In FIG. 5, there is shown a partial perspective view of the flange 14 with the barrel (12) engaged. Arrows 76 represent a release force being applied to the ends of the tabs 30, 30'. The release force 76 moves the cleats 34, 34' radially inward and out of engagement with the lip 74 formed at the openings 56, 56'. A separate rotational force is illustrated by arrow 78 and is discussed in further detail below.

Figure 4B:
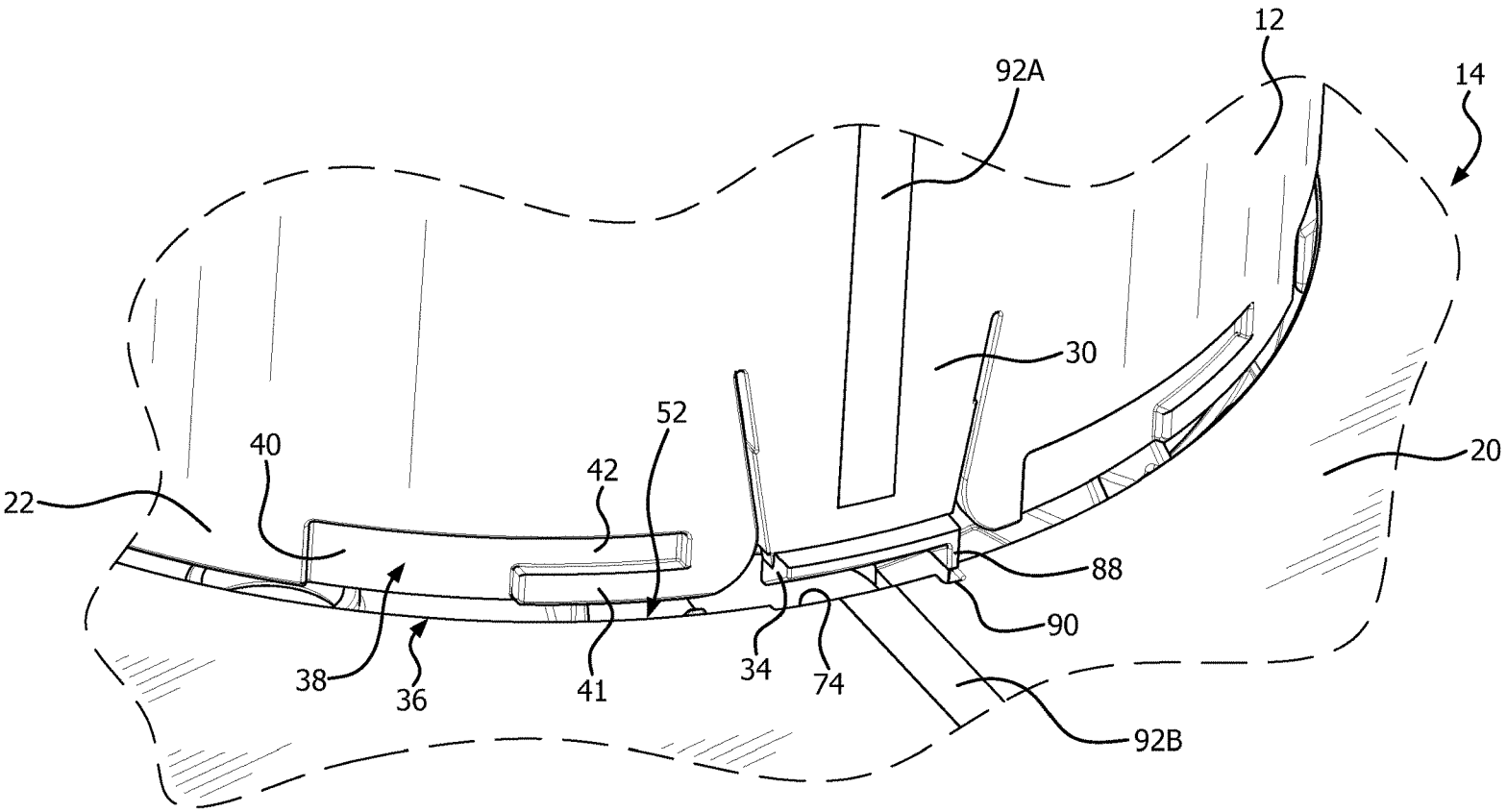
FIG. 4B shows a partial isometric view of the barrel and flange, prior to connection.
Figure 4C:
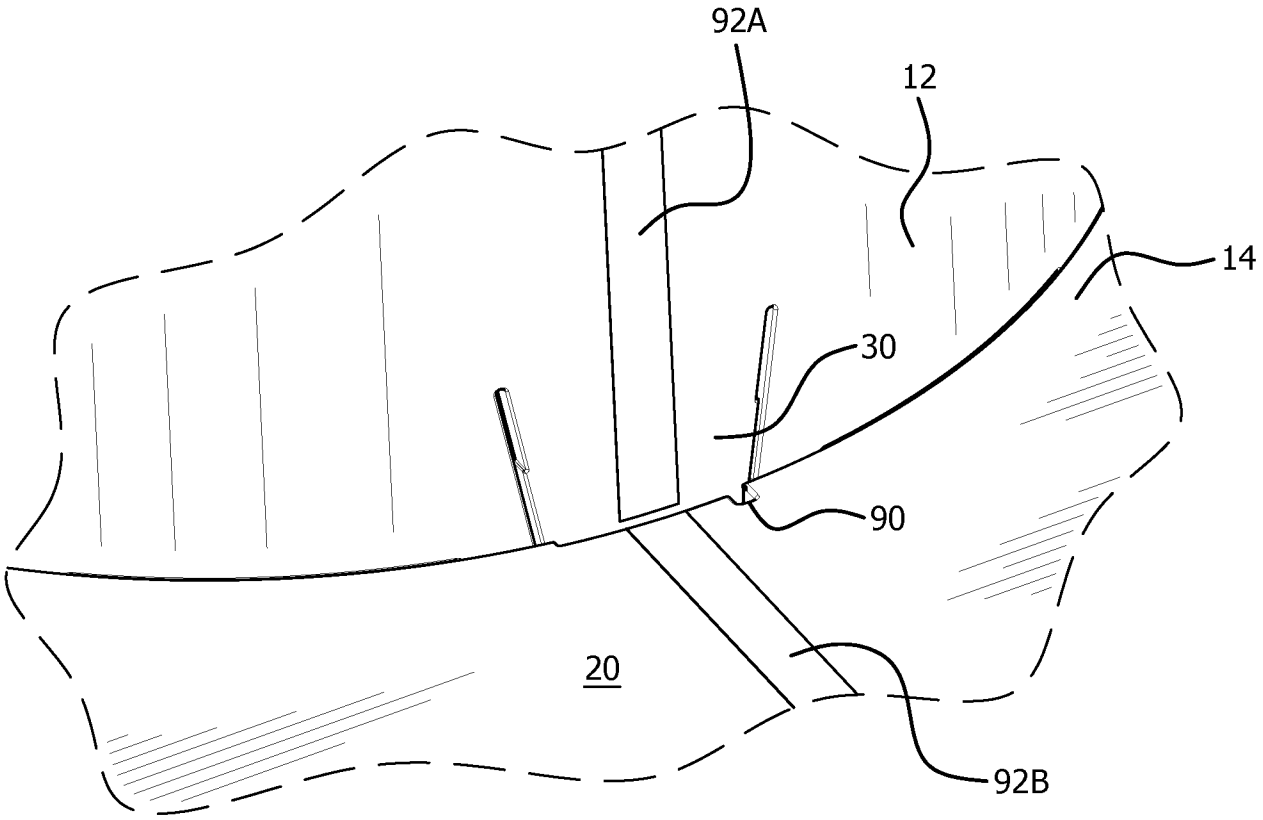
FIG. 4C shows a partial isometric view of the barrel and flange, after connection.

FIG. 4A shows the engagement of the cleat portion 34 of the flexible tab 30 of the barrel 12 with the lip 74 of the wall opening 56 in the outer wall 44 of the recess 26 in the flange 14. Also included in this figure is an alignment nub or tab 88 shown as part of the flexible tab 30 portion of the barrel 12. In FIG. 4B, the tab 88 is shown in alignment with an added alignment slot 90 formed in the support surface 20 of the flange 14, adjacent to the outer wall 44. Positional indicia, shown as lines 92A and 92B, is provided on the surfaces of the barrel 12 and flange 14. The positional indicia 92A, 92B respectively identify the position for the tabs 30, 30' on the barrel end 22 and the wall openings 56, 56' as shown in, for example, FIG. 4D. Upon a successful alignment, as the end section 22 of the barrel 12 is introduced into the receiving channel 52 of a flange 14, the alignment tab 88 moves into the alignment slot 90. As shown in FIG. 4C, the alignment tab 88 slides into the channel 90 as the flexible tab 30 flexes and the cleat 34 moves around the lip 74 adjacent the opening in the wall of the central recess. The alignment tab 88 and slot 90 may be replaced by other structures that force an alignment of the barrel 12 with the flanges 14 during introduction of the insertion section 22 into the central recess 26. Alternatively, as shown by, for example, FIGS. 1-3, the alignment structures may be omitted with the alignment relying on, for example, the positioning of the tabs 30, 30' with the wall openings 56, 56'.

Figure 6A:
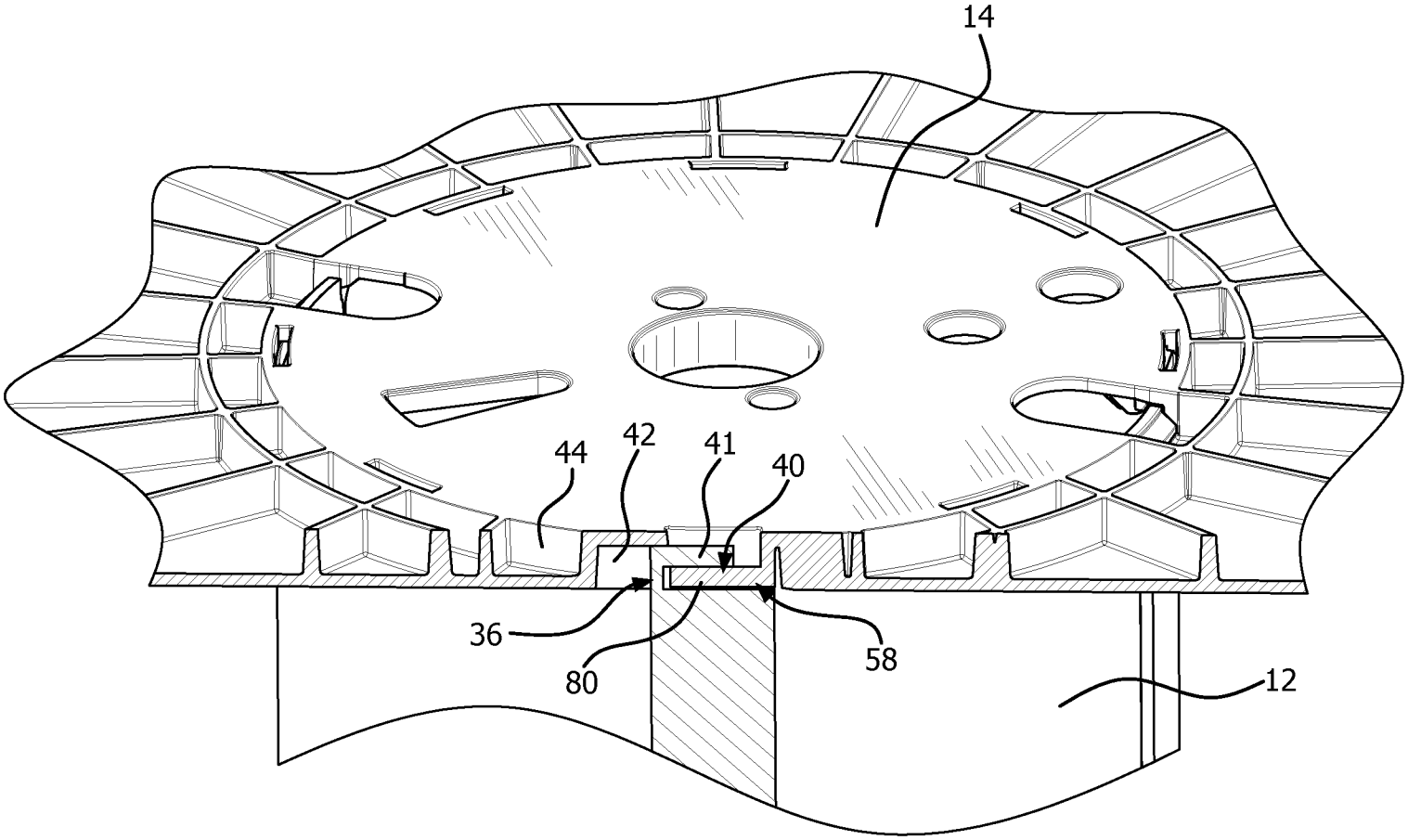
FIG. 6A shows a partial view of the spool, with portions of the flange and barrel shown in cross section.

In FIG. 6A there is shown in partial cross section the engagement between the clips 36 on the insertion section 22 of the barrel 12 and the receiving clips 58 formed on the outside wall 44 of the flange 14. The secondary engagement structure is formed by the engagement of the separate clip structures 36, 58, as is also shown in cross section of FIG. 6B. The insertion clips 36 formed on the end 22 of the barrel 12 have a shape corresponding to the receiving clips 58. There is a positional match between the barrel 12 and flange 14 when the tabs 30, 30' are aligned with the wall openings 56. 56' in the receiving channel 52. The base hook 80 of the flange clip 58 is positioned within the retention portion 42 of the release channel 40 of the barrel clip 36. The base hook 41 of the barrel clip 36 overlaps with the corresponding base portion 80 of the flange clip 58 to axially fix the flange and barrel 12.

Figure 6B:
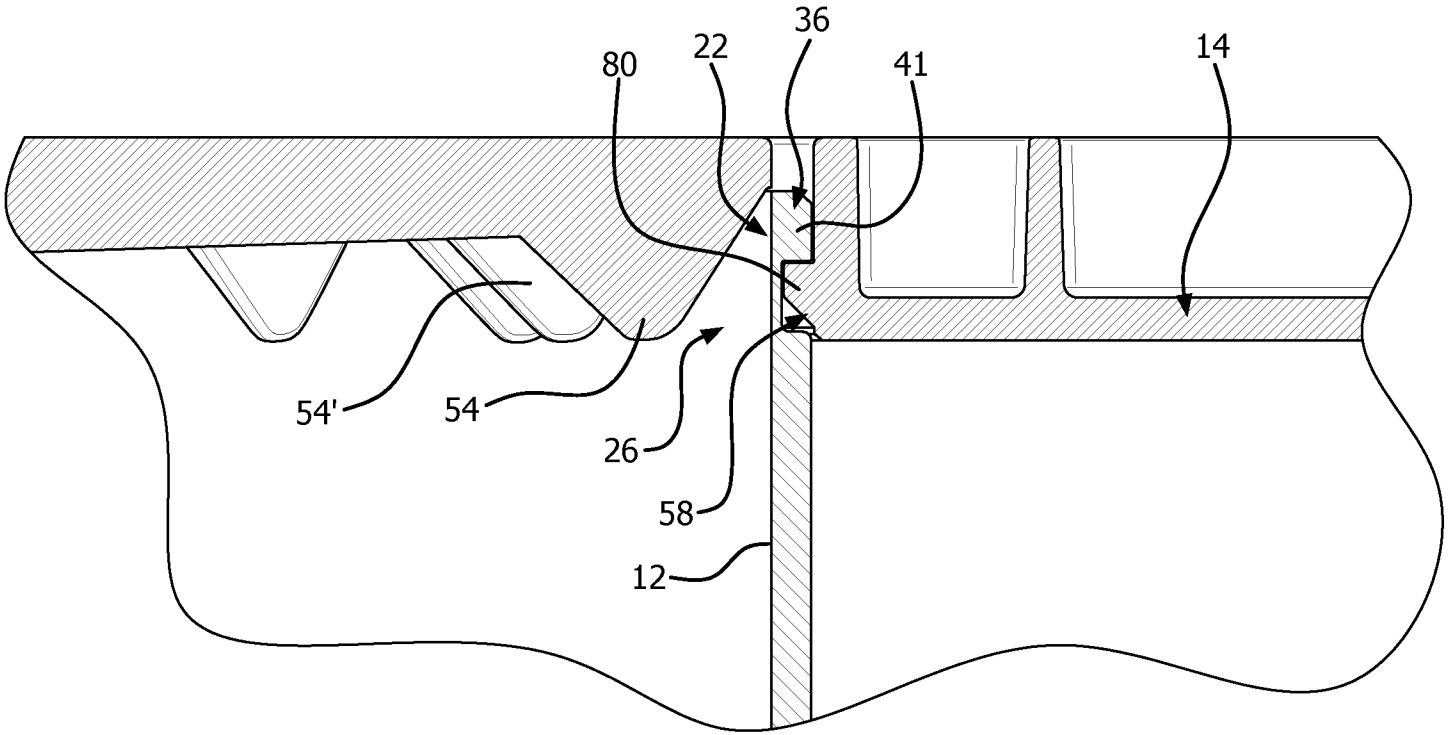
FIG. 6B shows a cross section view of a portion of the connection between the flange and barrel as taken along lines 6-6 in FIG. 3.
Figure 7A:
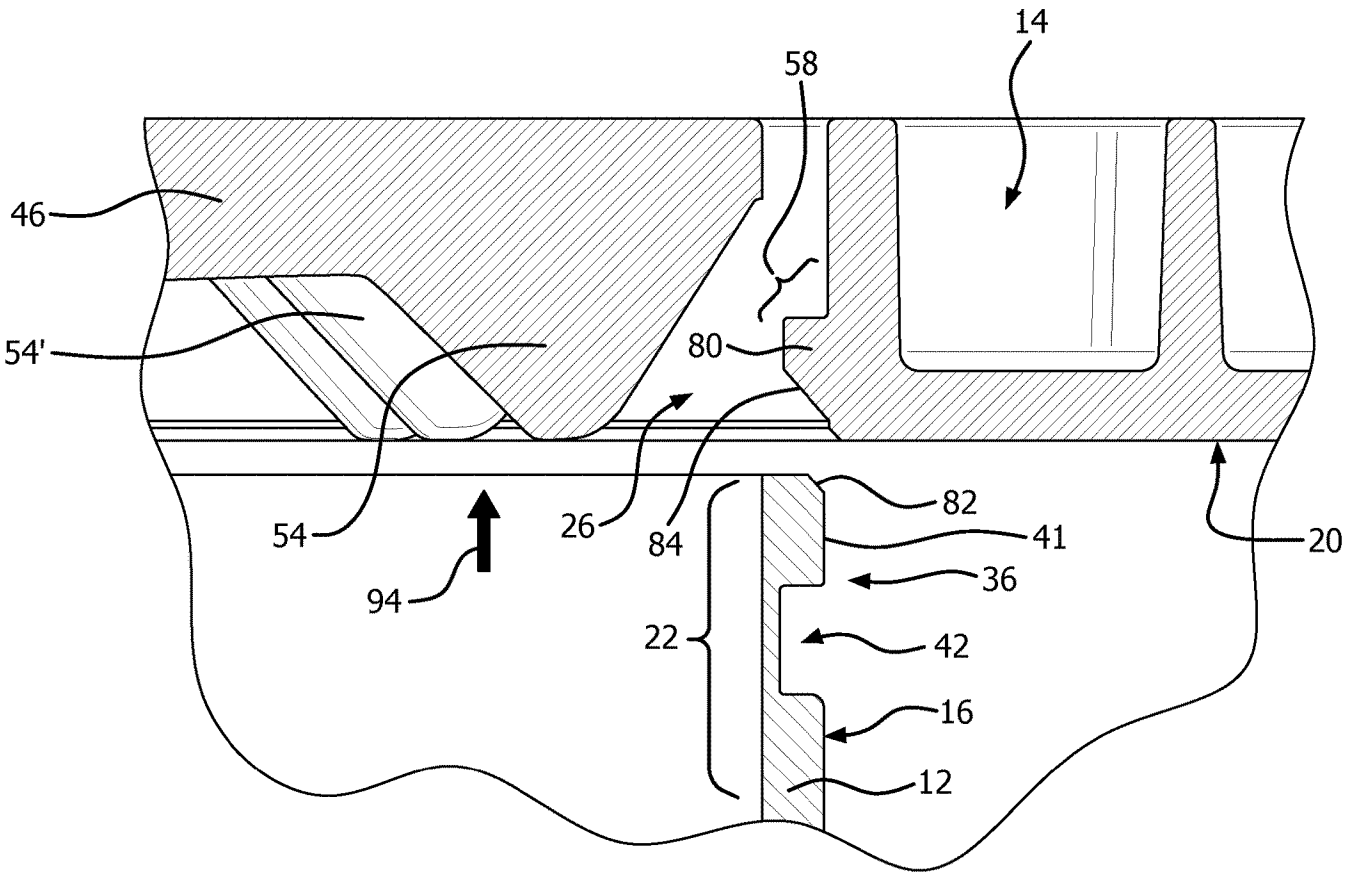
FIGS. 7A, 7B and 7C show partial cross section views of the sequence of the connection between the barrel and flange.
Figure 7B:
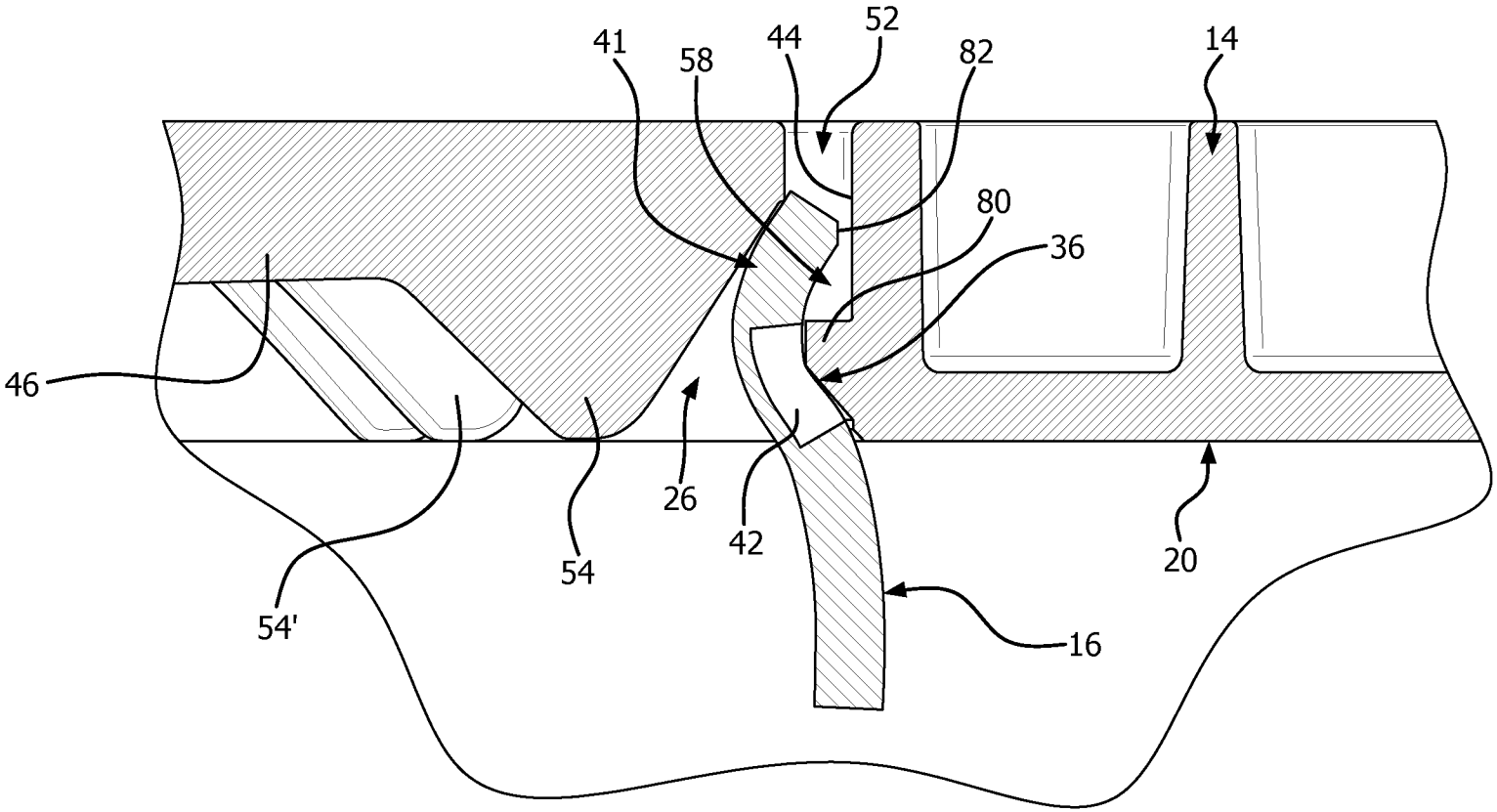
Figure 7C:
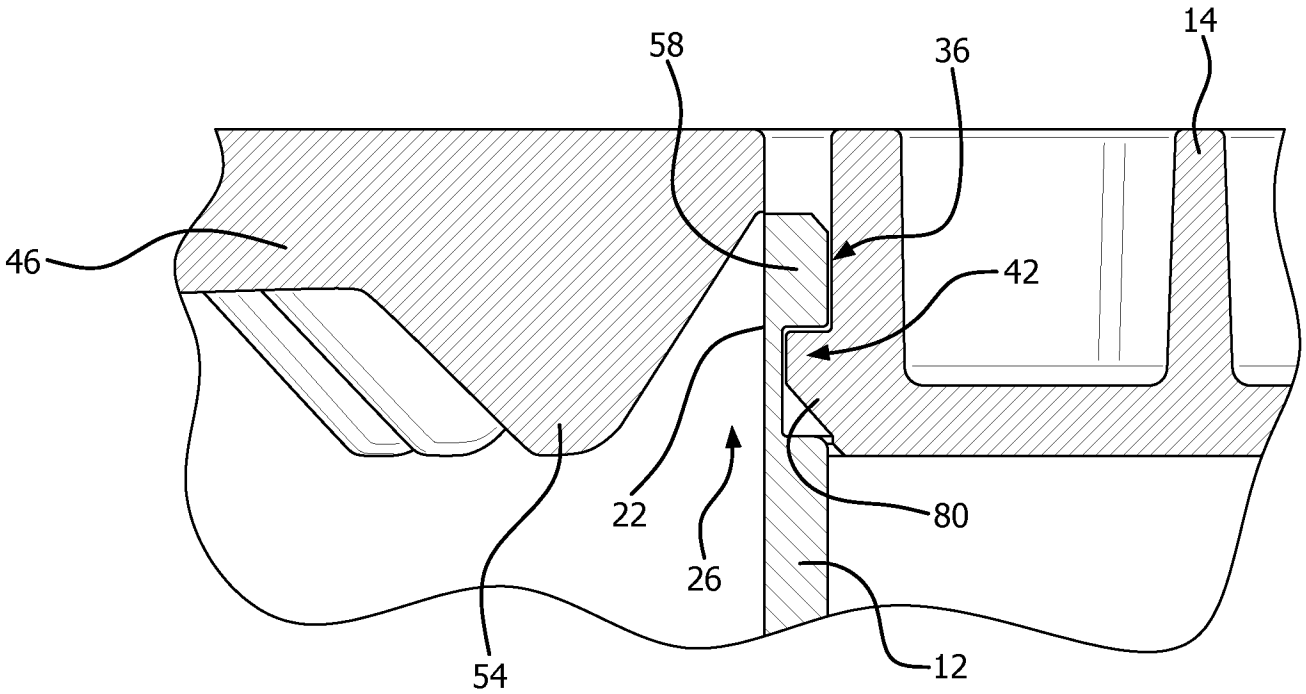

Creation of the overlapping relationship of the barrel clip 36 and the flange clip 58, as shown in FIGS. 6A and 6B, is illustrated in the sequence of FIGS. 7A, 7B and 7C. During introduction of the end 22 of the barrel 12 into the flange recess 26, the barrel clips 36 and flange clips 58 are aligned. This alignment is created by their positional relationship with respect to the tabs 30, 30' and the openings 56, 56' and the provided alignment structures including alignment tab 88, alignment slot 90, and indicia 92A, 92B. As shown in FIG. 7A, the barrel 12 is inserted axially into the flange recess 26 in the direction shown by arrow 94. No rotational movement is generally provided during the axial introduction. The base hook portion 41 of the insertion clip 36 on the end 22 of the barrel 12 is positioned radially outward on the barrel wall 16 and at the edge of the barrel end 22. The hook 80 for the flange clip 58 is positioned on the outer wall 44, adjacent the support surface 20. An angled surface 84 is provided on the flange hook 80 and a corresponding angled surface 82 is formed on the base hook 41 of the barrel clip 36. The angled surfaces 82, 84 are provided to assist in the continued insertion of the interfering clips 36, 58.

As shown in FIG. 7B, the initial contact between the two base hook portions 41, 80 causes the barrel end 22 to flex radially inward. As such the hook 41 of the clip 36 moves around the base hook 80 of the flange clip 58. The deformation of the end 22 of the barrel 12 is contemplated to be a function of the material properties of the barrel end. The form and overall dimensions of the barrel end 22, including the slots 32 adjacent the tabs 30, 30', and the dimensional relationship of the barrel 12, flange recess 26 and clips 36, 58. As the barrel end 22 progresses into the channel 52 the inner edge of the barrel, opposite the hook 41, engages the angled projections 54, 54' and is also supported by the ring 50 which forms a base support for the inside end of the barrel. Upon completion of the movement of the insertion section 22 of the barrel 12, the clip portions 36, 58 align and engage, as shown in FIG. 7C. The base portion 80 of the flange clip 58 engages within the retention portion 42 of the barrel clip 36. At the same time, due to the dimensional position of the cleat portion 34 of the tabs 30, 30', the tabs 30, 30' engage within the wall openings 56. 56' to axially lock the barrel 12 with respect to flange, as shown in cross section in FIG. 6B.

The overall axial support of the longitudinal end 24 of the barrel 14 within the central recess of the flange 14. The overlap of the clips 36, 58 and the engagement of the cleat 34 with the lip portion 74 of the opening serve to lock the barrel 12. The support ring 50 and related projections 54, 54' stiffen the wall of the insertion section 22 of the barrel 12, once the engagement occurs inside the receiving channel 52. In addition, the positioning of the alignment tab 88 within slot 90 and the engagement of the cleat 34 with the opening in the outer peripheral wall 44 of the receiving channel 52 fixes the rotative position of the barrel 12 within the central opening 26 of the flange 14. Only upon the inward flexing of the tabs 30, 30' (see arrows 76 in FIG. 5), will the insertion section 22 of the barrel 12 be able to rotate within the central recess 26 of the flange 14. Upon rotation (as shown by arrow 78 in FIG. 5), the overlap of the clips 36, 58 is removed. In this rotated position, the base hook portion 41 of each insertion clip 36 is moved into the release portion of the respective flange clip 58. Similarly, the base portion 80 of the receiving clip 58 on the flange 14 moves into the release portion 40 of the insertion clip 36 on the barrel 12. Once the overlap of the base portions 41, 80 is removed for each of the clip combinations, the barrel 12 may be axially withdrawn from the receiving channel 52 and separated from the flange.

In the embodiment of the breakdown spool as shown and described, the insertion section 22 of the barrel 12 and the central recess 26 of each flange 14 includes first and second engagement elements for releasably securing the flanges to the axial ends of the barrel. These engagement elements have different structural forms and provide different forms of engagement, resulting in a locking of the flange to the end of the barrel, until a desired manual release. Further, the first engagement elements and the second engagement elements are separately released. The insertion sections 22 of the barrel 12 and the central recess within the flanges also include alignment elements to locate the engagement elements for a proper fixing of the barrel and flange. These alignment elements may also serve to fix the relative rotative position of the barrel and the flange. Release of the alignment elements is also required to release the barrel from the flange.

The first engagement elements of the embodiment shown include two diametrically opposed flexible tabs 30, 30' formed within the barrel wall 16. It is noted that only one tab is required. In the alternative, additional tabs may be included. However, the inclusion of more than two tabs is not preferred, since it would serve to complicate release of the flange from the barrel. The flexible tabs 30, 30' include a base portion and a free end portion. The base portion of the tabs is connected to the barrel wall and the end portions of the tab include a radially outward projecting cleat 34. The tabs 30, 30' are capable of flexing radially about the base portion, with the normal (non-flexed) position of the tab being in-line with the winding surface 16 of the barrel 12. On the flange 14 is provided a pair of receiving openings 56, 56' that are formed within an outer peripheral wall of the central recess 26. The openings each define an engagement lip 74, adjacent to the support surface 20 of the flange 14. The openings 56, 56' are formed for receiving a projecting cleat 34 on a corresponding tab 30, 30' upon introduction of the insertion section 22 of the barrel 12 into the central recess 26 of the flange 14. The tabs are flexed radially inward so that the cleat 34 moves over or around the lip 74. The cleat 34 moves into and engages within the opening 56, 56' upon return of the tabs 30, 30' to the non-flexed position.

The second engagement elements are provided in the form of a plurality of spaced insertion clips 36 on the insertion section 22 of the barrel 12. A corresponding plurality of receiving clips 58 is provided on the peripheral wall 44 of the central recess 26. The receiving clips 58 are spaced relative to the pair of openings 56, 56' to match up with the insertion clips 36 on the end of the barrel 12. The receiving clips 58 are each formed to axially overlap and engage with a corresponding insertion clip 36 upon alignment of the flexible tabs 30, 30' with the openings 56, 56' during introduction of the insertion section 22 of the barrel 14 into the central recess 26 of the flange 14. The barrel wall adjacent the insertion clips 36 flexes movement of the insertion clips 36 around the receiving clips 56 to form the overlap and axial engagement. In internal support, such are ring 50 preferably engages the inside surface of the barrel, adjacent the overlap of the clips to deter or prevent axial separation. The engagement of the clips 36, 56 may be release based in a rotation of the flange with respect to the barrel. This rotation is possible only after release of the engagement of the cleats 34 from the lip 74 and opening 56, 56', and other alignment structures, such as the alignment tabs 88 and slots 90. After radially inward flexing of the tabs and axial release of the cleat from the lip and the opening, the relative rotational movement releases the axial overlap and engagement of the respective clips for axial withdrawal of the barrel from the flange.

The present disclosure makes reference various exemplary embodiments. It should be understood by those skilled in the art from the foregoing that various other changes, omissions and additions may be made therein, without departing from the spirit and scope of the invention, with the scope of the invention being described by the foregoing claims.

What is claimed is:

1. A breakdown spool comprising:

a barrel having a longitudinal axis, a barrel wall substantially surrounding the longitudinal axis and forming an annular winding surface, and an insertion section formed on at least one axial end of the barrel wall, the insertion section comprising at least one flexible tab formed within the barrel wall and having a radially outward projecting cleat on an end of the tab, and a plurality of fixed insertion clips spaced from one another and from the at least one tab; and at least one flange having a support surface, a central recess positioned within the support surface, the central recess forming a receiving channel for receiving the insertion section of the barrel, the central recess comprising a first opening for receiving the projecting cleat on the at least one tab upon rotation of the barrel relative to the flange into aligned positioning of the insertion section within the receiving channel and resilient flexing of the at least one tab relative to other portions of the insertion section of the barrel wall, and a plurality of fixed receiving clips spaced relative to the first opening corresponding to the spacing of the plurality of insertion clips relative to the at least one tab on the insertion section of the barrel wall, the receiving clips each formed for axial overlap upon rotation into the aligned positioning of the insertion section within the receiving channel with a corresponding insertion clip on the insertion section within the central recess, the at least one tab flexing radially inward upon introduction of the insertion section into the receiving channel, the inward flex of the at least one tab clearing the cleat for movement of the insertion section into the central recess and the rotation of the insertion section relative to the receiving channel, and an outward return of the at least one tab to a normal position upon moving the cleat into engagement with the at least one opening within the receiving channel, the engagement of the cleat on the at least one tab within the at least one opening fixing the rotative position of the barrel relative to the flange, wherein the insertion clips and receiving clips each comprise an engagement channel portion formed adjacent thereto, the engagement channel allowing rotational movement of the flange relative to the insertion section of the barrel after radially inward flexing of the at least one tab and release of the cleat from engagement with the first opening, the rotational movement of the flange and barrel releasing the axial overlap and engagement of the clips for withdrawal of the engagement of the barrel from the flange.

2. A breakdown spool as in claim 1, wherein the barrel comprises at least two flexible tabs formed on the insertion section of the axial end of the barrel, the at least two tabs each having a projecting cleat thereon.

3. A breakdown spool as in claim 2, wherein the at least two flexible tabs are spaced from one another and positioned diametrically opposite on the axial end of the barrel.

4. A breakdown spool as in claim 2, wherein the at least one flange further comprises a second opening, the first and second openings respectively aligned with the at least two tabs on the axial end of the barrel for receipt of the corresponding projecting cleats.

5. A breakdown spool as in claim 1, further comprising an alignment tab formed on the at least one tab, and an alignment slot formed on the flange adjacent the first opening, the alignment slot formed to receive the alignment tab upon alignment of the at least one tab and the first opening during introduction of the insertion section into the central recess.

6. A breakdown spool as in claim 1, wherein the barrel is integrally molded from a thermoplastic material.

7. A breakdown spool as in claim 1, wherein the barrel comprises a substantially central hollow defined by an inside wall of the winding surface.

8. A breakdown spool as in claim 1, wherein the central recess comprises an outer peripheral sidewall, the first opening formed within the peripheral sidewall and the plurality of receiving clips formed on the peripheral sidewall.

9. A breakdown spool as in claim 8, wherein the central recess further comprises an internal support positioned radially inward of the peripheral sidewall, the spacing between the internal support and the peripheral sidewall defining a channel formed for receiving the insertion section of the barrel, the internal support engaging with an inside wall of the barrel.

10. A breakdown spool as in claim 9, wherein the internal support comprise a ring member, the ring member having a projecting height within the central recess that is less than a height of the peripheral sidewall.

11. A breakdown spool as in claim 10 further comprising a plurality of radially extending support ribs formed within the central recess inwardly of the support wall.

12. A breakdown spool as in claim 11 wherein the internal support further comprises a plurality of angled projections integrally formed with the ring member and having a height greater than the height of the ring.

13. A breakdown spool as in claim 12, wherein the angled projections comprise a directing surface angled radially inward from the ring member.

14. A breakdown spool as in claim 13, wherein the angled projections are integrally formed with the support ribs.

15. A breakdown spool as in claim 14 further comprising a second plurality of angled projections are spaced from the angled projections formed with the support ribs.

16. A breakdown spool as in claim 8, wherein the projecting cleat comprises an angled engagement surface for engaging the outer periphery sidewall adjacent the first opening upon an initial introduction of the insertion section into the central recess.

17. A breakdown spool as in claim 1 further comprising alignment indicia on the barrel wall and on the flange support surface, the alignment indicia indicating the positional location of the at least one tab on the insertion section and the first opening within central recess.

18. A breakdown spool comprising:

a substantially hollow barrel having a longitudinal axis, a barrel wall surrounding the longitudinal axis and forming an annular winding surface, and an insertion section formed on each axial end of the barrel wall, the insertion sections each comprising two diametrically opposed flexible tabs formed within the barrel wall, each tab having a base portion and a free end portion, the tabs connected at the base portion to the barrel wall and the end portions having a radially outward projecting cleat thereon, the tabs capable of flexing radially about the base portion, and a plurality of insertion clips spaced from one another and from the two tabs; and a pair of similarly formed flange members, each flange member having a support surface, a central recess positioned within the support surface, the central recess forming a receiving channel for receiving the insertion section of the barrel, the central recess comprising an outer peripheral wall, the peripheral wall having an inside diameter closely dimensioned with an outside diameter of the annular winding surface of the barrel wall, a pair of receiving openings formed within the outer peripheral wall, the openings each defining an engagement lip adjacent the support surface, the openings formed for receiving the projecting cleats on the tabs upon introduction of the insertion sections of the barrel into the central recesses of a respective flange, and a plurality of receiving clips spaced relative to the pair of openings, the receiving clip spacing corresponding to the spacing of the plurality of insertion clips relative to the flexible tab on the insertion sections of the barrel wall, the receiving clips each formed to axially overlap and engage with a corresponding insertion clip upon alignment of the flexible tab with the first opening and introduction of the insertion section within the receiving channel, each of the tabs flexing radially inward upon introduction of the insertion section of one end of the barrel into the receiving channel of one of the flanges, the inward flex of the tabs clearing the cleat over the lip and for movement of the cleat into the aligned opening in the peripheral wall of the central recess and the return of the tabs to a normal position aligned with the barrel wall and moving the cleat into engagement with lip and the opening in the peripheral wall, wherein each of the insertion clips and receiving clips each comprise an engagement channel portion formed adjacent thereto, the engagement channel allowing relative rotational movement of the flange about the axis of the barrel after radially inward flexing of the tabs and axial release of the cleat from the lip and the opening, the relative rotational movement releasing the axial overlap and engagement of the respective clips for axial withdrawal of the barrel from the flange.

19. A breakdown spool as in claim 18, further comprising an alignment tab formed on at least one tab on each end of the barrel, and an alignment slot formed on the flange adjacent at least one of the openings in the peripheral sidewall of the central recess, the alignment slot formed to receive the alignment tab upon alignment of the flexible tab and the corresponding opening during introduction of the insertion section of the barrel into the central recess of the flange.

20. A breakdown spool as in claim 19, wherein the central recess of each flange further comprises an internal support positioned radially inward of the peripheral sidewall, the spacing between the internal support and the peripheral sidewall defining a channel formed for receiving the insertion section of the barrel, the internal support engaging with an inside wall of the barrel.

21. A breakdown spool as in claim 20, wherein the internal support on each flange comprise a ring member, the ring member having a projecting height within the central recess that is less than a height of the peripheral sidewall.

22. A breakdown spool as in claim 21 further comprising a plurality of radially extending support ribs formed within the central recess inwardly of the support wall.

23. A breakdown spool as in claim 22, wherein the internal support further comprises a plurality of angled projections integrally formed with the ring member and projecting for a height greater than the height of the ring.

24. A breakdown spool as in claim 23, wherein the angled projections comprise a directing surface angled inwardly from the ring member.

25. A breakdown spool as in claim 24, wherein the angled projections are integrally formed with the radially extending support ribs.

26. A breakdown spool as in claim 25 further comprising a second plurality of angled projections spaced from the angled projections formed with the support ribs.

27. A breakdown spool as in claim 18 further comprising alignment indicia on the barrel wall and on the flange support surface of each flange, the alignment indicia indicating the positional location of the at least one of the tabs on the insertion section on each end of the barrel and at least one opening within central recess.

28. A breakdown spool as in claim 1, wherein the barrel is integrally molded from a thermoplastic material.

29. A breakdown spool comprising:

a substantially hollow barrel having a longitudinal axis, a barrel wall surrounding the longitudinal axis and forming an annular winding surface, and an insertion section formed on each axial end of the barrel wall;

a pair of similarly formed flange members, each flange member having a support surface, a central recess positioned within the support surface, the central recess formed for receiving the insertion section of the barrel, the central recess having an outer peripheral wall, the peripheral wall having an inside diameter closely dimensioned with an outside diameter of the annular winding surface of the barrel wall;

the insertion section of the barrel and the central recess of each flange having first and second engagement elements, the first and second engagement elements having different structural forms; and the insertion section of the barrel and the central recess of each flange having interconnecting alignment elements to fix the relative position of the axial end of the barrel with respect to the central recess of the flange and to align the respective first and second engagement elements on the insertion section and the peripheral wall around the perimeter of the central recess, wherein the first and second engagement elements on one axial end of the barrel and on one flange being engaged upon connection of the alignment elements during axial introduction of the insertion section of the one axial end of the barrel into the central recess of the one flange, and wherein the first engagement elements are separately released from the second engagement elements and further release the connection of the alignment elements, and upon release of the first engagement elements the second engagement elements are released by rotation of the flange about the barrel axis with respect to the axial end of the barrel followed by an axial separation of the flange and barrel end.

30. A breakdown spool as in claim 29, wherein the first engagement elements further comprise:

two diametrically opposed flexible tabs formed within the barrel wall, each tab having a base portion and a free end portion, the tabs connected at the base portion to the barrel wall and the end portions having a radially outward projecting cleat thereon, the tabs capable of flexing radially about the base portion, and a pair of receiving openings formed within the outer peripheral wall, the openings each defining an engagement lip adjacent the support surface of the flange, the openings formed for receiving the projecting cleats on the tabs upon introduction of the insertion section of the barrel into the respective central recesses of the flanges, and each of the tabs flexing radially inward upon introduction of the insertion section of one end of the barrel into the receiving channel of one of the flanges, the inward flex of each of the tabs clearing the cleat over the lip and for movement of the cleat into the aligned opening in the peripheral wall of the central recess and the return of the tabs to a non-flexed position aligned with the barrel wall and moving the cleat into engagement with lip and the opening in the peripheral wall.

31. A breakdown spool as in claim 30, wherein the second engagement elements further comprise:

a plurality of insertion clips on the insertion section of the barrel, the insertion clips being spaced from one another and from the two tabs and a plurality of receiving clips on the peripheral wall of the central recess, the receiving clips spaced relative to the pair of openings, the receiving clip spacing corresponding to the spacing of the plurality of insertion clips relative to the flexible tabs, the receiving clips each formed to axially overlap and engage with a corresponding insertion clip upon alignment of the flexible tab with the first opening and movement of the insertion section into the receiving channel, the barrel wall adjacent the insertion clips flexing for movement of the insertion clips into engagement with the corresponding receiving clips, and wherein each of the insertion clips and receiving clips having an engagement channel portion formed adjacent thereto, the engagement channel allowing relative rotational movement of the flange about the axis of the barrel after radially inward flexing of the tabs and axial release of the cleat from the lip and the opening, the relative rotational movement releasing the axial overlap and engagement of the respective clips for axial withdraw of the barrel from the flange.

32. A breakdown spool as in claim 31, wherein the interconnecting alignment elements further comprise:

an alignment tab formed on at least one tab on each end of the barrel, and an alignment slot formed on the flange adjacent to at least one of the openings in the peripheral sidewall of the central recess, the alignment slot formed to receive the alignment tab upon alignment of the flexible tab and the corresponding opening during movement of the insertion section of the barrel into the central recess of the flange.

* * * * *